United States Patent [19]

Robbins et al.

[11] Patent Number: 4,643,645

[45] Date of Patent: Feb. 17, 1987

[54] STAGE FOR A STEAM TURBINE

[75] Inventors: Kenneth E. Robbins, Saratoga; Stephen G. Ruggles, Scotia; Dan Duncan; John C. Williams, both of Schenectady; Stephen K. Tung, Clifton Park; William J. Sumner, Mechanicville; Cuong V. Dinh, Schenectady, all of N.Y.

[73] Assignee: General Electric Company, Schenectady, N.Y.

[21] Appl. No.: 635,859

[22] Filed: Jul. 30, 1984

[51] Int. Cl.[4] ..... F01D 5/22

[52] U.S. Cl. ..... 416/190; 416/191; 415/183

[58] Field of Search ..... 415/181, 183, 217, 189; 416/190, 191, 192, 195, 196

[56] References Cited

U.S. PATENT DOCUMENTS

| | | | |
|---|---|---|---|
| 764,451 | 7/1904 | Geisenhoner | 416/191 |
| 2,935,246 | 5/1960 | Roy | 415/181 |
| 2,974,858 | 3/1961 | Koffel et al. | 415/181 |
| 2,974,927 | 3/1961 | Johnson | 415/181 |
| 3,328,867 | 7/1967 | Guengant | 416/191 |
| 3,527,544 | 9/1970 | Allen | 416/192 |
| 3,565,548 | 2/1971 | Fowler et al. | 416/235 |
| 3,575,523 | 4/1971 | Gross et al. | 416/191 |
| 3,719,432 | 3/1973 | Musick et al. | 416/190 |
| 3,778,190 | 12/1973 | Ouellette | 416/196 |
| 4,012,165 | 3/1977 | Kraig | 415/181 |

FOREIGN PATENT DOCUMENTS

| | | | |
|---|---|---|---|
| 2451453 | 3/1980 | France | 415/181 |
| 56906 | 5/1981 | Japan | 415/115 |
| 1287223 | 8/1972 | United Kingdom | 416/195 |
| 1509185 | 5/1978 | United Kingdom | 416/190 |

*Primary Examiner*—Edward K. Look
*Assistant Examiner*—John Kwon
*Attorney, Agent, or Firm*—Jerome C. Squillaro

[57] ABSTRACT

A stage of an axial flow turbine includes a plurality of spaced apart buckets and a plurality of spaced apart nozzle partitions, each plurality respectively circumferentially aligned about and axially spaced from each other along a rotor of the turbine. The nozzle partitions are circumferentially spaced such that a minimum throat extends a predetermined radial distance from the root, thereby forming a converging-diverging flow passageway between nozzle partitions. The trailing edge of the nozzle partitions are disposed to include axial and tangential lean with respect to the rotor. Buckets include a plurality of covers respectively connecting the tips and having a single outward radially extending sealing rib on the radially outer surface of each cover, wherein each rib is tangentially aligned with respective adjacent ribs. Buckets are overtwisted to compensate for untwist at operational speed to achieve optimum efficiency. Buckets are circumferentially spaced to provide a converging-diverging channel therebetween and include lashing for providing mechanical coupling at operational speed.

12 Claims, 13 Drawing Figures

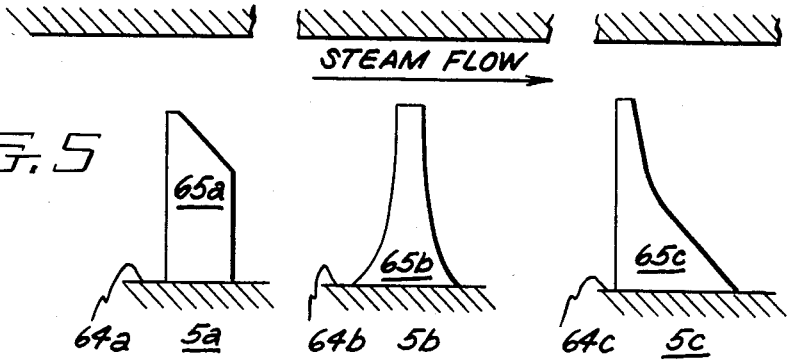
FIG. 5
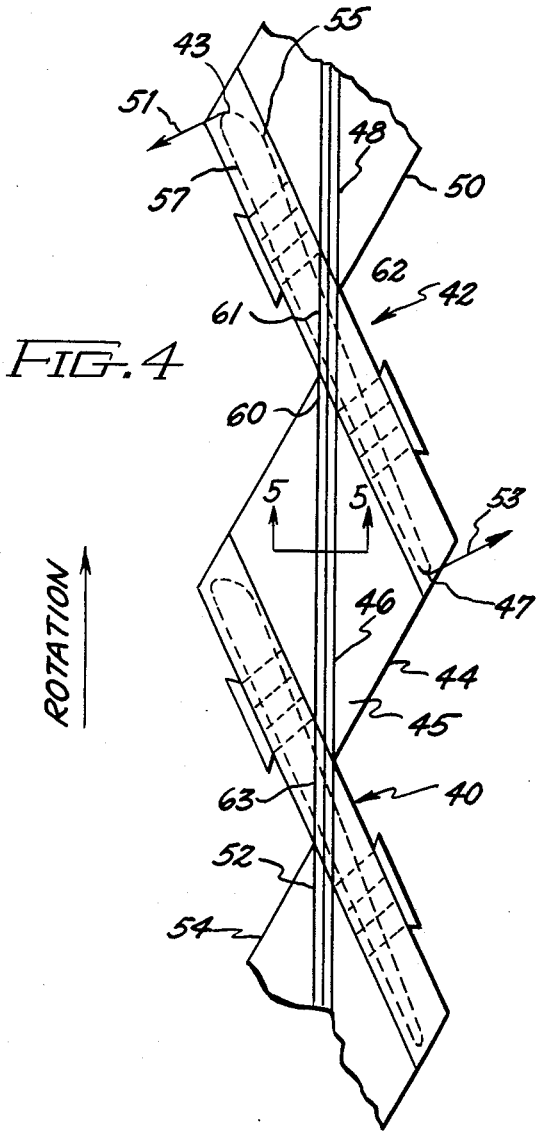
FIG. 4
FIG. 6
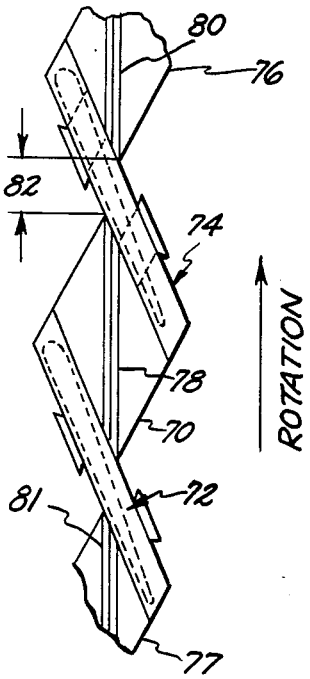

STAGE FOR A STEAM TURBINE

BACKGROUND OF THE INVENTION

This invention relates generally to an improved stage of an axial flow steam turbine, and more particularly to improvements in the last stage of an axial flow steam turbine for increasing efficiency thereof, thereby increasing overall turbine efficiency.

A stage of a steam turbine typically comprises a diaphragm including a plurality or set of circumferentially aligned and spaced apart stationary nozzle partitions and a plurality or set of circumferentially aligned and spaced apart rotating blades or buckets, fixedly secured to a turbine rotor at a predetermined axial position along the rotor and operatively spaced downstream from the corresponding plurality of nozzle partitions of the stage. Nozzle partitions of one stage are oriented to direct steam exiting from the next preceeding upstream stage onto the corresponding plurality of buckets associated with the one stage. The terms "upstream" and "downstream" are used herein with respect to the general axial flow of steam through the turbine.

Basically, energy is imparted to the rotor and bucket assembly of a steam turbine by an elastic working fluid, commonly steam. Steam is vented through a set of nozzle partitions of a diaphragm into a generally cylindrical chamber defined by the inner shell of the turbine housing. The shaft or rotor is coaxially and rotatably mounted within the chamber. Large steam turbines usually include several stages, each stage axially spaced apart from adjacent stages on the rotor shaft and stages sequentially increasing in diameter from the first or most upstream stage, near the point of admission of steam to the turbine, to the last or most downstream stage of the turbine which is proximate the exhaust conduit or hood of the turbine. From the exhaust conduit or hood of a low pressure turbine, spent steam is ultimately conveyed to a condenser. Generally, the ratio of the input pressure to the output pressure of rotor buckets of the last stage is greatest with respect to buckets from all other stages of the turbine, respectively.

Steam is admitted through the set of nozzle partitions of a stage into the chamber at a desired axial location and flows at least in one axial direction through a working passage. In a double flow turbine steam is centrally admitted and flows in generally opposing axial directions toward respective last stages. The working passage is generally defined by the axially displaced stages of the turbine as well as by the circumferential working area encompassed by the aerodynamic section (commonly called blade or vane profile) of turbine buckets in each stage. Each set of buckets extracts a part of energy available from steam by changing a portion of the available fluid kinetic energy into mechanical energy, as evidenced by operational rotation of the shaft and associated buckets of the turbine.

When steam is confined to the axial working passage, the turbine operates more efficiently than if steam is not so confined. Present twenty-six inch last stage buckets for a low pressure steam turbine manufactured by the General Electric Company are interconnected by tie wires and do not include covers connecting the outer tip portions of the buckets. A cover or cover piece has been used to connect together the outer tip portions of a pair of buckets from a last stage having longer buckets, say 30 inch and 33.5 inch. A plurality of covers, which correspond to the plurality of rotor buckets in the turbine stage, form a circumferential band around the radially extensive tip portions of the buckets. This circumferential band of covers prevents some steam from escaping from the axial working passage by limiting radial flow of steam past the outer tip portions of the buckets. The rotor and bucket assembly must be free to rotate within the turbine shell and therefore, a radial clearance gap exists between the radially extensive tips of the rotor buckets or outer surface of the covers, and the inner surface of the shell of the turbine.

In the last stage of a low pressure steam turbine working steam is normally below the saturation line. Therefore water droplets are apt to form upstream of last stage buckets, such as in the region of the last stage nozzle and diaphragm. Generally, water droplets are forced radially outward from the shaft by centrifugal force. Although water droplets generally have a low absolute velocity, the relative velocity, especially with respect to radially outer portions of last stage buckets is very fast, about equal to bucket tip tangential velocity.

Water droplets impinging leading edges of last stage buckets may cause impact erosion of the edges. Most erosion damage results from condensed moisture of preceeding stages which forms a film of water over last stage nozzle partitions. The film of water is continuously sheared off to form particles of water at trailing edges of last stage nozzle partitions by high velocity steam which sweeps over the partitions. Water particles move such a short distance between trailing edges of nozzle partitions until potential contact with a leading edge of a bucket that they cannot be accelerated to a very high absolute velocity and thus appear as relatively stationary objects with respect to rotating buckets.

The relative velocity of water droplets near bucket tips in a low pressure turbine which includes a last stage, active bucket length of about 26 inches is approximately fifteen hundred-fifty feet per second. The force at which a water droplet impacts a bucket blade is related to size or mass of the impinging droplet and relative velocity of the droplet with respect to the bucket. Since speed of the turbine is essentially established by other parameters, potential problems caused by water droplets, such as erosion, lower torque, and loss of efficiency, can be minimized by providing a turbine rotor and bucket assembly which effectively limits the amount of water and number and size of water droplets in the axial working passage of the turbine.

As stated earlier, the pressure ratio across the last stage of the turbine is greatest as compared with other upstream stages of the turbine. Also, the pressure differential across last stage buckets is generally higher near the radially outer portion of the rotating blades as compared with the root or radially inner portion of the blades. Therefore, the greater the radial clearance gap between the radially outermost rotatable component of the last stage and the inner surface of the shell, the greater the loss of steam and hence, the lower the efficiency of the last stage of the turbine.

It is important to insure that maximum working steam be forced through last stage buckets in order to extract available energy therefrom and that working steam which bypasses the last stage buckets be minimized. To minimize loss of steam flow around the outer portions of buckets, sealing strips have been placed on the inner surface of the turbine shell radially opposite the tip portions and covers of buckets in prior art apparatus. Generally, the sealing strips form a ring around the buckets and extend radially inward towards the bucket tip portions to narrow the radial clearance gap therebetween. The number of strips utilized per stage and the axial placement of the strips on the inner surface of the shell is based upon a study of fluid mechanics in a steam turbine. Sealing strips should be axially located such that the strips are approximately opposite the steady state centerline of the rotating buckets.

The steady state centerline is the centerline of buckets when the turbine is in normal operation at rated speed. However, since the rotor shaft, upon which the buckets are mounted, expands due to thermal reaction to steam, optimum axial placement of sealing strip, i.e., at the steady state centerline, is not easily ascertained. Also, the axial position of rotating blades changes during operation of the turbine, especially when the turbine experiences transient changes in its mechanical load or changes in the condition and volume of steam supplied thereto.

Prior attempts to prevent steam from escaping and bypassing the working passage of the last stage have also included common labyrinth seals disposed in the radial gap between the radially outermost portion of the bucket cover and the inner surface of the shell. Labyrinth seals typically comprise ribs radially extending from the bucket cover which cooperate with circumferential flanges inwardly projecting from the inner surface of the shell. Projections from the inner surface of the shell prevent water from smoothly flowing past the last stage buckets along the inner surface of the shell and may cause water droplets to fall into the working passage of the last stage from the projections. When labyrinth seals are used, a moisture removal channel disposed through the inner wall of the shell immediately upstream the seal permits a portion of the working steam to escape through the channel, thus carrying water along with it. A similar moisture removal channel is required if the aforementioned sealing strips are used.

Although steam leakage flow around the outer tip portions of buckets is reduced by incorporation of labyrinth seals, some working steam is lost through the moisture removal channel without having passed through the last stage buckets. Further, steam and water exiting through the moisture removal channel is at a higher pressure than the input pressure to the condenser from the output of the last stage and thus appropriate conduits and orifices may be necessary for connecting the moisture removal channel to the condenser in order to adjust the pressure of steam and water from the water removal channel to minimize flow of leakage steam to the condenser.

The design of the last stage of a steam turbine to achieve optimal operating efficiency requires use of interdisciplinary science and engineering such as aerodynamic, structural, mechanical and manufacturing along with generally several iterations of design alternatives. It is especially worthwhile to ensure that operation of the last stage yields optimum stage efficiency since the last stage recovers substantially more energy, typically about 10% of the overall turbine output, from steam than any other stage in the turbine and thus has a significant impact on overall efficiency of the turbine. Other factors which make design and operation of a last stage different from other stages of a turbine include: higher volume flow of steam through the last stage than through any other stage and therefore, last stage buckets are longest and subject to highest stresses; ability to efficiently operate with variable exhaust pressure (upstream stage outputs are at relatively constant pressure ratio) resulting in variable stage pressure ratio, variable energy output, and variable aerodynamic conditions; greater moisture content in last stage working steam than any other stage; and, last stage buckets have highest tip speed, highest flow velocities and greatest three-dimensional flow effects with respect to buckets of any stage in the turbine.

Last stage buckets of low pressure turbines, i.e., turbines having a steam output design pressure from the last stage typically less than about 5.0 inches of mercury absolute, generally have a long and thin bucket profile, and are thus subject to untwisting due to centrifugal forces acting thereon during turbine operation. It is desirable that the untwist be accounted for so that turbine buckets obtain optimum aerodynamic relationship during normal turbine operation. At nominal 3600 rpm operational speed the speed of the bucket in the tip section may be about 1550 feet per second for a 26 inch last stage bucket which creates a relative supersonic environment for steam flowing between turbine blades. It is important to control the distribution of the transition region from subsonic to supersonic flow through last stage buckets in order to prevent undesirable shock waves and corresponding loss in efficiency. In addition, it is possible to obtain supersonic steam flow through last stage nozzle partitions and likewise the transition region from subsonic to supersonic flow must be controlled to ensure that desired steam flow conditions are maintained through the nozzle partitions to the input at the last stage buckets. An improper or unexpected transition region through nozzle partitions may result in a loss of efficiency due to undesirable shock patterns. A transition from subsonic to supersonic flow may be accompanied by a shock wave which causes an irreversible loss of pressure, i.e., pressure is lost and cannot be recovered to produce mechanical energy.

In contrast to the last stage of a low-pressure steam turbines, gas turbines generally employ integral covers over bucket tips which prevent untwisting of buckets; gas turbine bucket profiles are generally short and stubby and typically are manufactured from a superalloy with a coating to resist the harsh gas turbine environment; gas turbine last stage discharge pressure is relatively constant i.e., atmospheric; and gas flow through a gas turbine is an open system whereas steam flow through a steam turbine, and subsequent steam condensation and water reheat to form steam, is a closed system. Although steam turbines may experience problems with occluded water or condensed steam as hereinbefore mentioned, the harsh environment of a gas turbine generally does not exist within a steam turbine and thus, in view of the foregoing, it would generally not be expected that one skilled in the art of steam turbine design and manufacture would look to gas turbine art to teach or suggest solutions which may be specifically applicable to steam turbines.

Accordingly, it is an object of the present invention to provide a sealing arrangement for retaining steam within the axial working passage of a stage of an axial flow steam turbine while protecting stage components from mechanical damage due to moisture without prematurely removing moisture from the stage.

Another object is to provide positive control over the positioning of the elastic fluid flow transition region from subsonic to supersonic (i.e. transonic expansion region) in the last stage of a low pressure steam turbine to prevent formation of undesirable sonic shocks during operation.

Yet another object is to control untwist of last stage steam turbine buckets to obtain optimum aerodynamic orientation during normal operating conditions.

Still another object is to provide optimum diaphragm and bucket cooperation to supply desired steam flow and to help delay onset of recirculating flow as manifested by bucket root flow separation at low average annulus velocity of elastic fluid flow through the last stage of a steam turbine.

SUMMARY OF THE INVENTION

In accordance with the present invention, a stage of an axial flow turbine for converting at least a portion of energy available from an elastic fluid into mechanical energy, comprises a plurality of buckets affixed to and circumferentially aligned around a rotor of the turbine, a plurality of bucket covers respectively connecting the tip section of adjacent buckets, one rib respectively extending radially outward from the radial outer surface of each of the covers, each rib being tangentially aligned with respect to ribs on adjacent covers, the ribs in close proximity yet spaced from a shell of the turbine, and a diaphragm axially spaced from the plurality of buckets and circumferentially disposed around the rotor, the diaphragm including a plurality of nozzle partitions and an inner ring for fixedly securing at the root the plurality of nozzle partitions. Each of the nozzle partitions is disposed to include an axial and a tangential lean with respect to a radial reference from the axis of rotation of the rotor. The inner ring includes a greater outward radial extent adjacent the leading edge of the nozzle partitions than the outward radial extent adjacent the trailing edge of the nozzle partitions. Further, each of the plurality of nozzle partitions is spaced from an adjacent nozzle partition such that the channel formed therebetween includes a minimum throat and a trailing edge throat, wherein the minimum throat is disposed between the leading edge of the nozzle partition and the trailing edge throat at the root of the nozzle partition and the minimum throat is disposed monotonically more proximate the trailing edge throat at increasing radial distance from the root of the nozzle partition, whereby the margins of the channel define a converging-diverging passageway at least over a portion of the radial extent of the nozzle partition.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

BRIEF DESCRIPTION OF THE DRAWING

FIG. 4 is a radial inward top view of turbine buckets in accordance with the present invention.

FIGS. 5*a*, 5*b* and 5*c* are cross-sectional views of different embodiments of a sealing rib in accordance with the present invention.

FIG. 6 is a radial inward top view of an alternate embodiment of turbine buckets in accordance with the present invention.

DETAILED DESCRIPTION

Figure 1:
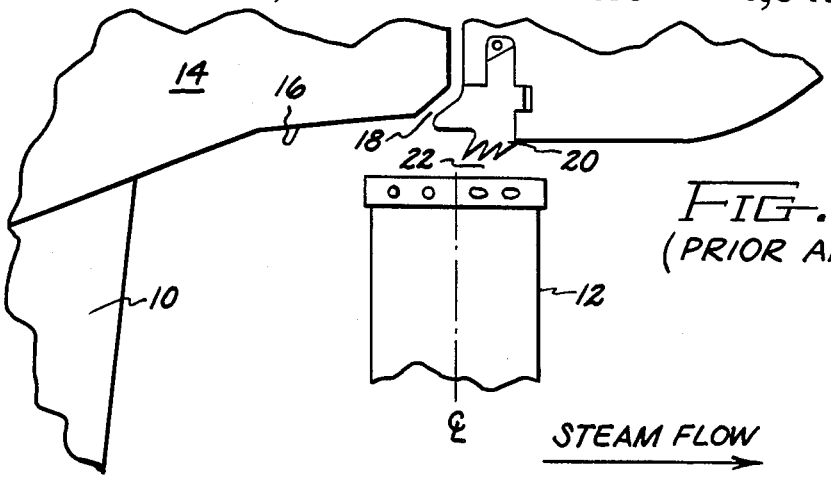
FIG. 1 (PRIOR ART)
FIG. 1 is a cutaway portion of a tangential side view of a stage of a steam turbine constructed in accordance with teachings of the prior art.
Figure 2:
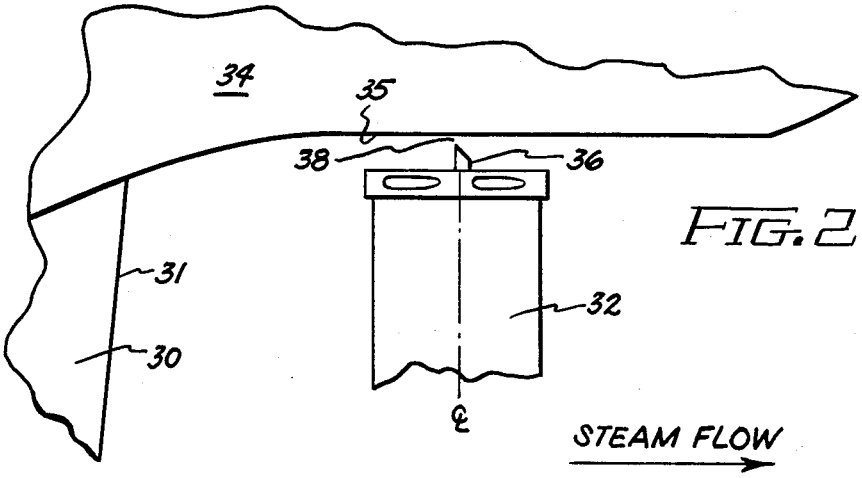
FIG. 2 is a cutaway portion of a tangential side view of a stage of a steam turbine constructed in accordance with teachings of the present invention.
Figure 3:
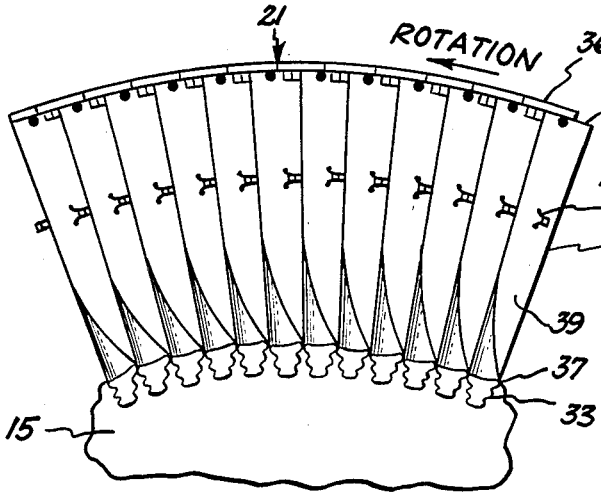
FIG. 3 is a partial axial view of a stage of a steam turbine looking in the direction of line 3—3 of FIG. 8 in accordance with the present invention.

FIG. 1 generally illustrates a steam turbine including a moisture removal device in accordance with principles taught by the prior art. The steam flow is designated by an arrow in both FIGS. 1 and 2. U.S. Pat. No. 4,335,600, issued to Wu et al., illustrates a cutaway view of a steam turbine as FIG. 1 therein, and such disclosure is incorporated herein by reference thereto. Only a partial cutaway, radial side view is shown in FIGS. 1 and 2, but it is to be understood that the turbine includes a rotor, diaphragm and bucket assembly of which only the radially outer portion is illustrated herein. A better understanding of the turbine stage can be gained by viewing FIG. 3 which illustrates a rotor 11 with buckets 32 affixed to a rotor shaft 15 by securing means 33, such as dovetails. FIG. 3 is a partial axial view of a segment of the turbine stage which extends 360° around rotor shaft 15. Like reference numerals designate similar components throughout this description.

In FIG. 1, the stage, which includes a bucket 12, is surrounded by a coaxial shell 14 of the turbine. A nozzle partition 10 is upstream of bucket 12 and is part of the turbine stage. Nozzle partition 10 directs the flow of steam onto the blade of bucket 12. Shell 14 has a radially inner surface 16 including a radial moisture removal slot 18 therethrough. Some steam which has not yet passed through the buckets of the stage escapes through slot 18. Slot 18 removes a water film which flows axially along surface 16 before the film is deflected by a sealing strip 20 towards rotating bucket 12. As stated earlier, sealing strip 20 is effective to limit the flow of steam axially around the radially extensive tip portions of bucket 12 through radial clearance gap 22 but would deflect water flowing along shell surface 16 onto the high velocity tip portions of bucket 12 if slot 18 was not immediately upstream of strip 20.

Referring to FIG. 2, a last stage of a steam turbine constructed in accordance with the principles of the present invention is shown. A nozzle partition 30, having a trailing edge 31 upstream from a bucket 32, directs steam onto the buckets of the last stage of which bucket 32 is an illustrative member. A shell 34 of the turbine, having an inner surface 35, coaxially surrounds the rotor and bucket assembly. Inner surface 35 provides an unimpeded flow path for water to flow past the outer portion of bucket 32 toward an exhaust hood (not shown) and ultimately to a condenser (not shown). To limit the flow of steam around the radially extensive tip portions of bucket 32, a single rib 36 extends radially outward from the radially outer surface of a cover and the tip of bucket 32 (the cover is not visible from the viewpoint of FIG. 2). The radial extension of a rib 36 is illustrated in FIG. 3 wherein rib 36 extends beyond the radially extensive portion or tip section 19 of bucket 32. Returning to FIG. 2, the radially extensive edge of rib 36 is in close proximity to surface 35. A radial clearance gap 38 has substantially the same dimensions as clearance gap 22 illustrated in FIG. 1. By way of example, the dimension of the radial clearance gap is on the order of 0.150 inch for the last stage of a low-pressure turbine having an active bucket length of about 26 inches. Gap 38 is large enough to permit unimpeded anticipated flow of water along surface 35 during normal operation of the turbine.

Referring to FIG. 3, bucket 32 comprises a fastening means 33, such as a dovetail, for fixedly securing bucket 32 to shaft 15, a root section 37 at the radial inner extremity of bucket 32, and tip section 19 at the radial outer extremity of bucket 32. Bucket 32 is secured to an adjacent bucket with a nub and sleeve device described in detail in U.S. Pat. No. 3,719,432—Musick et al., assigned to the instant assignee and incorporated in its entirety herein by reference.

FIG. 4 illustrates a radial top view of a pair of buckets 40 and 42 (similar to bucket 32) connected together at their respective outer radial tips by a cover 44. A detailed description of cover 44, its relationship with tips of buckets and the operating characteristics with respect to the turbine as a whole can be found in a U.S. Pat. No. 3,778,190, by J. H. Ouellette, assigned to the instant assignee and incorporated herein in its entirety by reference.

Cover 44 includes a rib 46 extending from its radially outer surface 45. Rib 46 is similar to rib 36 as illustrated in FIGS. 2 and 3, respectively. Rib 46 extends radially outward from the circumferential surface defined by the plurality of covers which connect a corresponding plurality of bucket tips of the stage together. Rib 46 is tangentially aligned with a rib 48 of an adjacent cover 50 and a rib 61 of bucket 42. Similarly, rib 46 is tangentially aligned with a rib 52 of an adjacent cover 54 and a rib 63 of bucket 40.

In a preferred embodiment, leading end 60 of rib 46 is in close proximity to the trailing end of rib 61 and the leading end of rib 61 is in close proximity to trailing end 62 of rib 48. The leading and trailing designations relate to the direction of rotation as shown by an arrow in FIG. 4. In a similar fashion, the trailing end of rib 46 is in close proximity to the leading end of rib 63 of bucket 40 and the trailing end of rib 63 is in close proximity to the leading end of rib 52.

Rib 46, in combination with ribs 52, 63, 61 and 48 and other ribs corresponding to the plurality of buckets and covers of the stage, form a substantially continuous, radially extending circumferential ring 21 (FIG. 3) effective to provide a seal between the radially outer portion of the buckets and the shell of the turbine as hereinbefore explained. When ribbed cover 44 is used with the last stage of a low pressure steam turbine unit, it is not necessary to remove the film of condensate which accumulates and axially flows along the inner surface 35 of turbine shell 34, since ring 21 (FIG. 3) is the only impediment to steam flow through radial clearance gap 38 (FIG. 2). Hence, the moisture removal slot 18 (FIG. 1) is unnecessary and therefore can be eliminated. Since the dimensions of radial clearance gap 38 (FIG. 2) are similar to the dimensions of radial clearance gap 22 (FIG. 1) an improvement in efficiency of the turbine stage in accordance with the present invention is achieved by saving an estimated 0.6% of the total steam flow through the stage. The estimated saving of 0.6% represents the estimated loss of steam flow passing through moisture removal slot 18 (FIG.1). Conservation of 0.6% of the steam flow increases efficiency of the stage and thereby increases overall turbine efficiency.

In a presently preferred embodiment, rib 46 is an integral part of cover 44. Since buckets may expand radially due to thermal stimulus or move radially due to mechanical reactions experienced during turbine operation, rib 46 may comprise a relatively abradible material with respect to the material of the inner surface 35 of shell 34 (FIG. 2). A portion of rib 46 will "rub off" if the rotor and bucket assembly should experience an abnormal deviation in rotation from the normal axis and contact inner surface 35 of shell 34. The axial centerline of the turbine stage may be shifted during operation such as by thermal expansion of the rotor or change in bearing alignment. Sealing ability of the single ribbed cover apparatus described herein is not influenced by axial movement of the centerline of the stage. Also, the single ribbed cover apparatus including a plurality of tangentially aligned ribs is effective to provide a seal for any turbine stage which has water flowing along the inner surface of the shell surrounding that turbine stage, thus obviating need of moisture removal slot 18 (FIG. 1).

FIGS. 5*a*, *b* and *c* illustrate several possible corss-sectional views of a rib constructed in accordance with the principles of this invention.

Geometric configuration of the rib is an important consideration because steam flow through radial clearance gap 38 (FIG. 2) is related to rib profile. The radially extensive edge of the rib is preferably relatively narrow as compared with the base of the rib proximate the cover. Other features relate to: the ratio of the height of the rib to the width of its base which may be in the range of about 1.7 to about 2.0; the ratio of the height of the rib to the steady state radial clearance gap distance which may be greater than or equal to about 1.7, preferably about 2.0; and the ratio of the width of the radially extensive edge of the rib to the steady state radial clearance gap distance which may be less than or equal to about 0.10. Ratios of 2.0, 1.7 and 0.10, respectively, have been theoretically proposed for optimum performance of a rib as a sealing means in the last stage of a turbine with about 26 inch active bucket length. In operation geometric features of a single rib, as hereinabove described, confine steam flowing through radial clearance gap 38 (FIG. 2) into a smaller radial space than is actually physically present between rib 36 (FIG. 2) and inner surface 35 of shell 34 (FIG. 2). This phenomenon may be explained by the vena-contracta theory, which theory is relatively well known in the fluid mechanics art. Thus, the single rib 36 decreases the amount of flow of elastic fluid or steam through radial clearance gap 38 (FIG. 2) from the total flow which would be expected through radial clearance gap 38 (FIG. 2) if no rib 36 (FIG. 2) were used. The cross-sectional configurations of a rib which performs optimally are based upon a study of fluid flow through an orifice and other sealing devices in accordance with principles of fluid mechanics. A single rib extending above each cover is important because a greater number of axially spaced ribs on the same cover may not conserve as much steam flow through radial clearance gap 38 (FIG. 2) as does only one rib per cover and therefore may not increase the sealing performance attained by a single rib in accordance with the present invention. Further, sealing performances of two axial spaced ribs depends on the axial spacing between them, which axial spacing is a function of the size of clearance gap 38 (FIG. 2). In order for a second rib to augment sealing performance of rib 36 (FIG. 3), the axial spacing between rib 36 and the second rib would generally be so large as to not be able to be accommodated on a cover 44 (FIG. 4) of the present invention. Also, a single rib which does not radially extend beyond the outer radial tip portions of the buckets does not conserve steam flow as described herein.

Three radial cross sectional views of ribs, such as may be taken along line 5—5 of FIG. 4., which may be utilized in accordance with principles of this invention are illustrated in FIGS. 5*a, b* and *c*. The illustrated ribs are not the only ribs which could be constructed in accordance with the principles described above, but are illustrative of the type of rib which operates efficiently in the environment described herein. Ribs 65*a, b* and *c* extend above outer radial cover surfaces 64*a, b* and *c*, respectively. The direction of steam flow is shown by an arrow and is representative of the direction of flow in FIGS. 5*a, b* and *c*. In FIG. 5*a*, rib 65*a* has a trapezoidal cross-sectional configuration with a downstream face being angled to form a declination angle of greater than about 40°, preferably between 40° and about 60° and most preferably about 45° from a horizontal reference plane. FIG. 5*b* illustrates rib 65*b* as including a relatively wide base proximate surface 64*b* which progressively narrows from the relatively wide base to the radially extensive edge. The radially extensive or top edges of ribs 65*a, b* and *c* are truncated. Rib 65*c*, illustrated in FIG. 5*c*, has a relatively straight radially extending upstream wall surface, a truncated radially extensive edge and a relatively wide base proximate surface 64. Therefore its cross-sectional view narrows relatively progressively from its base to its radially extensive edge. A person of ordinary skill in the art could detail many different profiles, shapes and configurations of a rib which extends from the outer surface of a cover and operates in accordance with the principles of the present invention.

FIG. 6 illustrates an alternate embodiment of the present invention. A cover 70 connects the tip of a rotor bucket 72 to the tip of adjacent rotor bucket 74. A cover 76 and a cover 77 respectively connect adjacent buckets to buckets 74 and 72, respectively. A radially extending rib 78 projects above the outer surface of cover 70 and is tangentially aligned with respect to rib 80 which is integral with cover 76 and with respect to rib 81 which is an integral part of cover 77. The trailing end of rib 80 is spaced from the leading end of rib 78. A space 82 separates the trailing end of rib 80 from the leading end of rib 78. Hence, rib 78 does not project over the tip portion of bucket 74 but terminates proximate thereto and rib 80 similarly terminates proximate the tip portion of bucket 74. A similar space may be present between corresponding ribs on adjacent covers 70 and 77 as illustrated. Steam flow around the radially extensive tip portion of the rotor buckets and through the space is relatively small in this embodiment because space 82 and similar spaces along the outer circumference of the stage comprise a relatively small part of the substantially continuous, radially extending ring formed by the plurality of ribs associated with the plurality of covers of the turbine stage. Steam flow through space 82 is substantially limited when the turbine is operating.

This invention may be utilized with covers which are connected to the buckets by laterally extending tenons which mate with lateral holes in outer tips of the buckets, i.e., the specific covers illustrated herein. The covers illustrated herein are typically called side entry covers, and are clearly described in U.S. Pat. No. 3,778,190, incorporated herein as previously noted. Other types of covers, may also utilize a rib as described herein. This invention may also be practiced by connecting a predetermined number of buckets of a stage together in a group yet not connecting respective grouped buckets together, wherein a stage comprises a plurality of grouped buckets. Although there may be breaks or gaps between respective groups of buckets in the relatively continuous radially extending ring formed by the ribs, in operation, buckets rotate such that axial steam flow through the breaks are relatively minimal. This invention may be practiced such that the covers and ribs form an integral part of the buckets.

Figure 7:
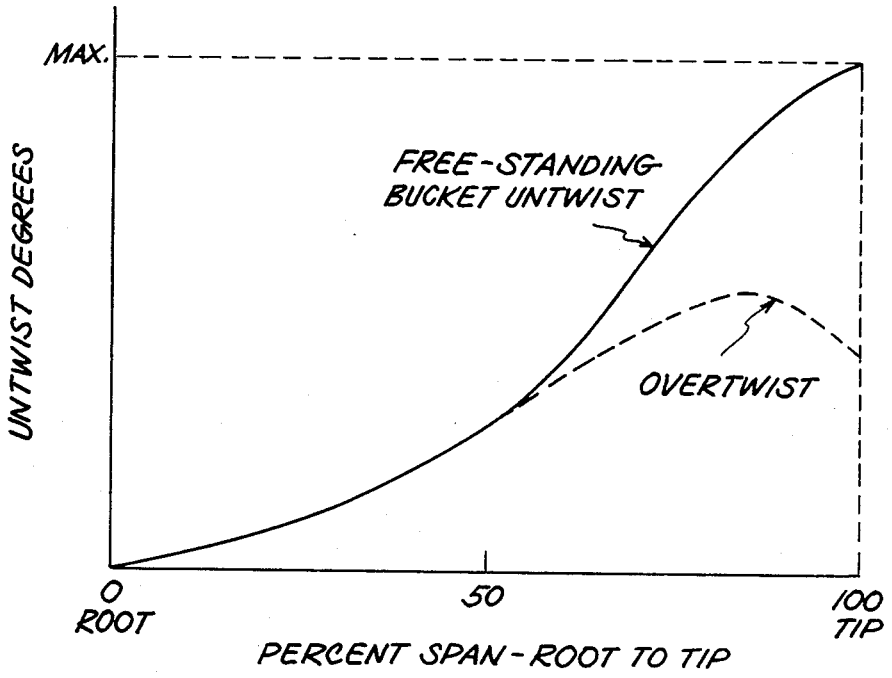
FIG. 7 is a graph showing the amount of untwist of a conventional bucket and overtwist of a bucket in accordance with the present invention.

Referring to FIG. 7, another aspect of the present invention is illustrated. The solid curve of FIG. 7 shows the amount of untwist in degrees expected from a free-standing bucket 42 (FIG. 4) at nominal operating speed, for example 3600 rpm. As indicated in FIG. 4, when the rotor begins to rotate and increase speed toward operating speed, say 3600 rpm, bucket 42 will tend to untwist in the direction of arrow 51 from leading edge 43 of bucket 42 and in the direction of arrow 53 from trailing edge 47 of bucket 42. When bucket 42 is at operating speed, it is desirable that the aerodynamics of bucket 42 and its relationship to adjacent buckets of the stage be as close to the optimal design specifications as possible for obtaining optimum efficiency from the stage. For example, it may be desirable that supersonic flow conditions be controlled by a transonic bucket configuration such as described in U.S. Pat. No. 3,565,548—Fowler et al, which is assigned to the instant assignee and incorporated herein in its entirety by reference. It is also important that stresses on the tenons of cover 44 from buckets 40 and 42 do not exceed a predetermined limit in order to maintain reliability of the configuration and to prevent damage to tenons of cover 44 or corresponding mortises of buckets 40 and 42. Accordingly, buckets 40 and 42 are overtwisted by the additional amount shown by the dashed line in FIG. 7 in order to minimize load or stress on the tenons of cover 44, such that upon untwisting at operational speed buckets 40 and 42 will attain the desired aerodynamic configuration. An effective amount of overtwist is provided such that even with overtwist, cover 44 restrains some untwisting at the tip of bucket 42, thereby maintaining a predetermined stress on the tenons of cover 44 at operational speed in order to provide mechanical coupling to help suppress undesired bucket vibrations. At the optimum aerodynamic orientation of bucket 42 at operational speed, it is desirable to have a predetermined level of stress on the tenons of covers 44 and 50 in order to maintain mechanical coupling between bucket 42 and 40 for providing damping of undesirable mechanical vibrations which may occur. In addition, it is desirable that the nub and sleeve lashing device described in aforementioned U.S. Pat. No. 3,719,432 be aligned at operational speed such that only the radial outward thrust of centrifugal force provides mechanical coupling between the nubs and respective sleeve.

Figure 8:
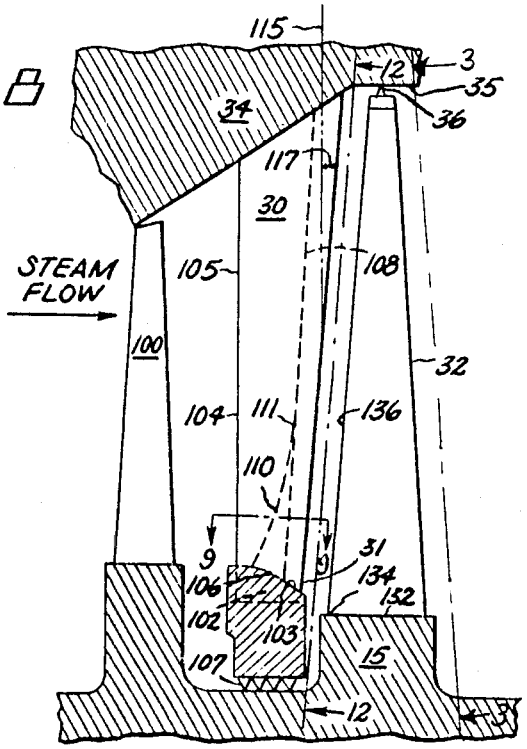
FIG. 8 is a tangential view of a stage in accordance with the present invention.

Referring to FIG. 8, a tangential view of a last stage in accordance with the present invention is shown. Also illustrated is a representative bucket 100 from the next to the last stage or L−1 (L minus one) stage of the turbine.

A diaphragm 105 comprises nozzle partition 30, including a leading edge 104, and an inner diaphragm ring 102 for fixedly retaining the root of nozzle partition 30. The outer portion or tip of nozzle partition 30 is fixedly secured to shell 34. Trailing edge 31 of nozzle partition 30 is axially leaned so that the radially outermost portion of trailing edge 31 is axially further downstream than the radially innermost portion of trailing edge 31. That is, trailing edge 31 of nozzle partition is skewed with respect to a radial axis 115 of shaft 15 by an angle 117. Angle 117 is preferably less than about 5°.

Figure 9:
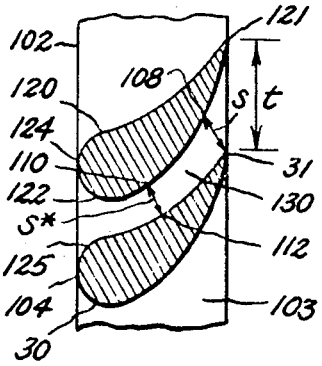
FIG. 9 is a radially inward view looking in the direction of line 9—9 of FIG. 8.

Referring to FIG. 9, a radially inward view taken along line 9—9 of FIG. 8 is shown. Nozzle partition 30 and an adjacent nozzle partition 120 are shown. For convenience and ease of understanding, only two nozzle partitions are shown. It is to be understood that a plurality of nozzle partitions respectively having the same relative disposition as nozzle partitions 30 and 120 are disposed in diaphragm 105 (FIG. 8) and circumferentially surround shaft 15 (FIG. 8).

Trailing edge 31 of nozzle partition 30 and a corresponding trailing edge 121 of nozzle partition 120 appear as a point in FIG. 9. The distance between trailing edge 31 and trailing edge 121 is the pitch of the nozzle partitions and is designated by the letter t. The distance from trailing edge 31 of nozzle partition 30 to the closest point 108 on the suction surface 122 of nozzle partition 120 is called the exit or trailing edge throat and is designated by the letter s.

In order to control supersonic flow through a channel 130 between nozzle partitions 30 and 120, it is necessary for channel 130 to decrease in flow area from the upstream entrance (between leading edges 104 and 124 of nozzle partitions 30 and 120, respectively) of channel 130 to a minimum flow area disposed between the upstream entrance and downstream exit (between trailing edges 31 and 121 of nozzle partitions 30 and 120, respectively) of channel 130 and then to increase in flow area from the location of the minimum flow area to the downstream exit of channel 130, thus forming a converging-diverging flow path through channel 130. Minimum flow area through channel 130 occurs at the minimum throat where, for example, the distance from a point 110 on suction surface 122 of nozzle partition 120 to a point 112 on pressure surface 125 of nozzle partition 30 is minimum and is indicated by the symbol s*. It is also common practice to indicate flow areas rather than distances and in such case the symbols s and s* are replaced by A and A* respectively. The ratio s/t as a function of radial distance from the root of a nozzle partition is also commonly used to define the spatial relationship between adjacent nozzle partitions.

Returning to FIG. 8, the locus of points 108 on nozzle partition 120 defining the exit throat on the suction surface 122 of nozzle partition 120 between nozzle partitions 30 and 120 (FIG. 9) is shown. Also indicated is the locus of points 110 on nozzle partition 120 defining the minimum throat between nozzle partition 30 and 120 (FIG. 9). A corresponding locus of points 112 (FIG. 9) on pressure surface 125 of nozzle partition 30 is not shown in FIG. 8 for maintaining clarity. It is noted that locus 110 of the minimum throat commences downstream of leading edge 104 of nozzle partition 30 and upstream of the locus of points 108 at the root of nozzle partition 30. Locus 110 of the minimum throat between nozzle partitions 30 and 120 (FIG. 9) is monotonically disposed further downstream or closer to locus 108 for increasing radial distance from the root of nozzle partition 30 until locus 110 merges with locus 108, i.e., minimum throat s* occurs coincident with and is equal to exit throat s, at a predetermined point 111 intermediate the root and tip of nozzle partition 30. The outward radial extent of the point of merger 111 between locus 108 and locus 110 is determined by the amount of control of supersonic flow which is desired. Typically, the velocity profile through channel 130 (FIG. 9) is such that the greatest velocity of steam flow occurs at the root with the velocity decreasing in steam flow radially removed from the root toward the tip of nozzle partition 30. It is necessary to control the direction and occurrence of supersonic shocks in order to maintain optimum efficiency. Undesired or unexpected shocks may accompany distorted steam flow through channel 130 (FIG. 9) and thus present off optimal steam conditions to the input of bucket 32 resulting in decreased stage efficiency.

The radially outer surface or periphery 103 of inner ring 102 of diaphragm 105 is contoured for controlling and directing steam flow toward the root 132 of bucket 32. From leading edge 104 of nozzle partition 30 to a point 106 on periphery 103 of inner ring 102, the profile of surface 103 is preferably an arc of a circle having a predetermined radius. Thus the contour of surface 103 of inner ring 102 from leading edge 104 of nozzle partition 30 to point 106 defines a partial surface of a torus or doughnut circumferentially around periphery 103. The locus of points 106 around inner ring 102 is a circle disposed intermediate minimum throat margin 110 and exit throat margin 108. From point 106 to trailing edge 31 of nozzle partition 30, the profile of surface 103 is preferably a straight line which if extended would intersect at juncture 134 of leading edge 136 and root 132 of bucket 32. Thus the contour of surface 103 of inner ring 102 from point 106 to trailing edge 31 of nozzle partition 30 defines the surface of a truncated cone circumferentially around periphery 103. Of course, other shapes and contours of periphery 103 effective for controlling and directing steam flow radially inward toward the root of an associated bucket may be used.

Figure 10A:
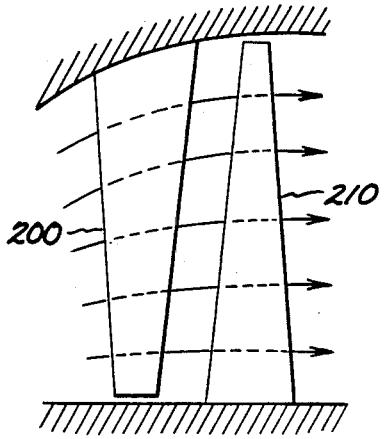
FIGS. 10*a* and 10*b* are simplified diagrams showing fluid flow through a stage of a steam turbine.
Figure 10B:
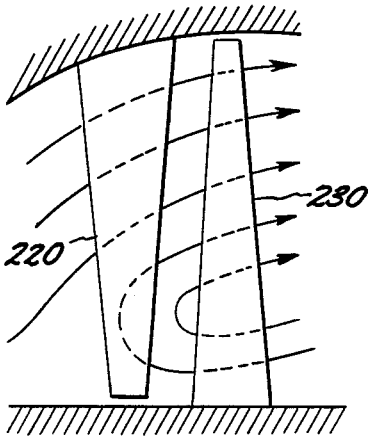

Referring to FIGS. 10*a* and 10*b*, steam flow through a simplified stage is shown. In FIG. 10*a*, a desired steam flow, indicated by flow lines with arrowheads, for obtaining optimum efficiency is shown. Steam, which is generally expanding, from the adjacent upstream stage (not shown) is directed in accordance with the present invention by a nozzle partition 200 to enter a bucket 210 and exits bucket 210 in a substantially axial direction. In FIG. 10*b*, an undesirable steam flow, indicated by flow lines with arrowheads, is shown.

The last stage of a steam turbine, especially a low pressure turbine, must be capable of operation with a variable exhaust volume flow of steam, typically expressed as a function of the average axial annulus velocity $V_{ax}$, while minimizing the effects of such variation on efficiency. Variations in exhaust volume flow of steam occur due to fluctuations in power output generated by the turbine, since steam mass flow through the last stage varies approximately linearly with the output power of the turbine, and due to exhaust pressure variations, since exhaust pressure for a typical turbine operating environment is not constant. Exhaust pressure from a turbine is a function of condenser design and operating conditions and is primarily affected by temperature of cooling water input to the condenser. Generally a large quantity of water is required for cooling and typically it may be supplied from a source exposed to the weather which accordingly experiences temperature shifts over a year due to seasonal changes.

During normal condenser and turbine operation at a load within from about 40% to about 100% of optimum output design load for the turbine, steam flow through the last stage should be similar to that shown in FIG. 10*a*. When steam flow through the last stage is reduced and/or when exhaust pressure of the stage is increased, a radially outward component of velocity is imparted to the steam flow, especially at the bucket, which may cause flow separation or flow starvation (i.e., inadequate flow for optimum efficiency) starting at the root of the bucket and ultimately may result in a recirculating steam flow pattern as shown in FIG. 10*b*. Recirculating flow is undesirable and must be avoided since it causes a large decrease in efficiency. In one aspect of the present invention, features of the diaphragm, including nozzle partitions, and of buckets coact to delay onset of such recirculating flow thus permitting maximal efficiency operation over a wider range of steam flow and exhaust pressure conditions than do conventional stage designs.

Figure 11:
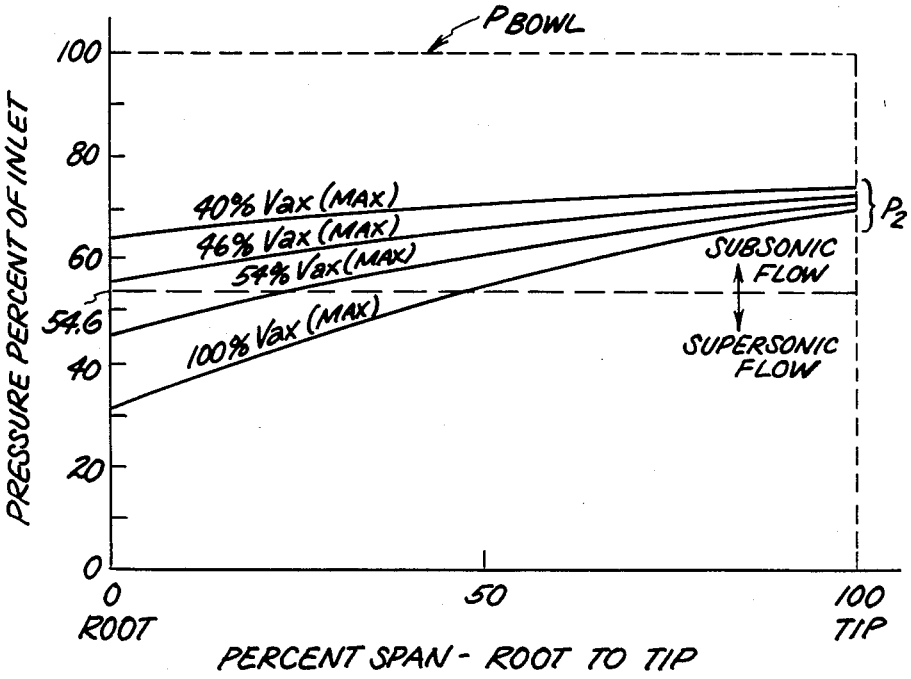
FIG. 11 is a graph of pressure characteristics across a representative nozzle partition in accordance with the present invention.

Referring to FIG. 11, representative pressure operating characteristics of a last stage in accordance with the present invention are shown. The ordinate represents nozzle partition exit pressure $P_2$ relative to nozzle partition inlet pressure. Nozzle partition inlet pressure is nominally the output pressure from the L−1 stage of the turbine and is commonly designated $P_{BOWL}$. The abscissa represents the percent of radial span from the root (closest to shaft) to the tip (closest to shell) of a nozzle partition. When the ratio of the input pressure to the output pressure across a nozzle partition at a predetermined radial location on the nozzle partition is greater than about 1.83 then a transonic (i.e., subsonic to supersonic) flow region will occur within the flow channel defined by the nozzle partition at the predetermined radial location. The boundary for transonic flow is indicated in FIG. 11 and intercepts the ordinate at a value of about 54.6% (i.e. $P_{BOWL}/P_2=1.83$ or $P_2=0.546\ P_{BOWL}$). Legends on the curves of FIG. 11 are representative of typical values of average axial annulus velocity $V_{ax}$ as a percentage of the maximum or design average axial annulus velocity $V_{ax}$(max) which may be encountered during turbine operation.

As is shown in FIG. 11, for $V_{ax}=V_{ax}$(max), there is a relatively large difference (i.e. about 37% $P_{BOWL}$) in pressure $P_2$ between the tip (about 68% $P_{BOWL}$) and the root (about 31% $P_{BOWL}$) of a nozzle partition. This pressure difference is counterbalanced by the inertia force of the flow with a high tangential velocity between nozzle partition and bucket. When $V_{ax}$ is decreased, say for example $V_{ax}=0.40\ V_{ax}$(max) the difference (about 8% $P_{BOWL}$) in pressure $P_2$ between root (about 64% $P_{BOWL}$) and tip (about 72% $P_{BOWL}$) substantially decreases. Inertial forces of flow between nozzle partitions and bucket also decrease when $V_{ax}$ is decreased, but not as rapidly as does the difference in pressure between root and tip of the nozzle partition for an equivalent decrease in $V_{ax}$. Ultimately, $V_{ax}$ may be decreased to a value at and below which steam flow cannot completely fill the steam path and then recirculating flow, as hereinbefore described, may occur.

Coaction of nozzle partition 30 (FIG. 8) and bucket 32 (FIG. 8) in accordance with the present invention increases acceptable operating range of exhaust pressure and steam flow in the turbine to delay onset of flow recirculation. The acceptable ranges are increased by imparting to steam flowing between a region of nozzle partitions, wherein the region extends from the root to a predetermined radial distance from the root, a predetermined inward radial component of velocity or momentum.

The imparted inward radial component of momentum opposes inertial forces of steam flow generated by tangential velocity of steam flow which opposition causes an effective reduction in the magnitude of the inertial forces, thereby delaying onset of root flow separation and recirculating flow at the bucket.

Figure 12:
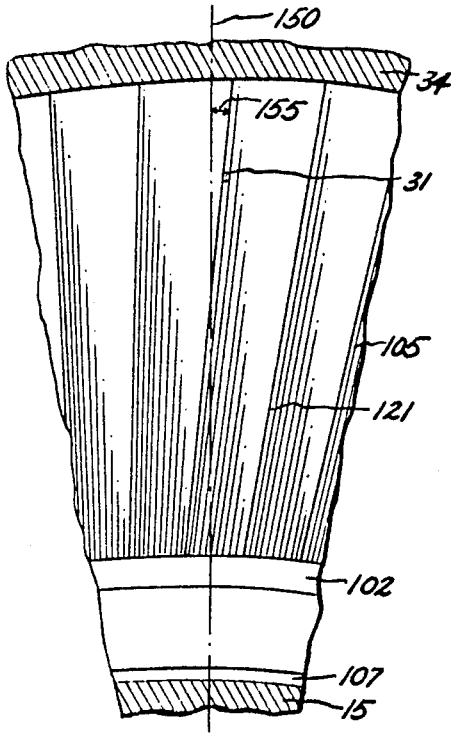
FIG. 12 is a view looking in the direction of line 12—12 of FIG. 8.

Referring to FIG. 12, a partial radial view (not to scale) taken along line 12—12 of FIG. 8 is shown. It is to be understood that diaphragm 105 extends circumferentially entirely around shaft 15. Trailing edge 31 of nozzle partition 30 and trailing edge 121 (FIG. 9) of nozzle partition 120 (FIG. 9) are identified and are representative of the purality of nozzle partitions circumferentially surrounding shaft 15. A reference line 150 radially extends through the axis of rotation of shaft 15. Trailing edge 31 is tangentially skewed or leaned with respect to reference line 150. Angle 155 between reference line 150 and trailing edge 31 of nozzle partition 30 is preferably less than about 12°. Thus, in one aspect of the present invention, axial and tangential lean of nozzle partitions 30 and 120, inner wall contouring of inner ring 102 of diaphragm 105, positioning of minimum throat s* (FIG. 9) between nozzle partitions 30 and 120 and positioning a converging-diverging channel between buckets at the root coact to delay onset of recirculating flow through the stage, thus permitting maximal efficiency over a wider range of steam flow conditions and exhaust pressure changes than do conventional stage designs.

Thus has been illustrated and described a sealing arrangement for retaining steam within the axial working passage of an axial flow steam turbine while protecting stage components from mechanical damage due to moisture without permaturely removing moisture from the stage. Further, positioning of transonic steam flow region to prevent formation of undesirable sonic shocks during operation has been shown and described. In addition, control of untwist of last stage buckets has been illustrated and described. Also optimum diaphragm and bucket cooperation to supply desired steam flow and to delay onset of recirculating flow, especially at low average annulus velocity, has been shown and described.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. A stage of an axial flow turbine for converting at least a portion of energy available from an elastic fluid into mechanical energy, comprising:

a plurality of buckets affixed to and circumferentially aligned around a rotor of said turbine, each bucket including an aerodynamic region intermediate an outer tip section and a inner root section, wherein the turbine includes a shell having an inner surface for circumferentially surrounding said plurality of buckets:

a plurality of bucket covers, each of said plurality of covers respectively connecting the tip secction of adjacent buckets and each of said plurality of covers including an outer surface, wherein each of said plurality of covers permits untwisting of each respective bucket of said plurality of buckets during turbine operation;

one rib respectively extending radially outward from the outer surface of each of said plurality of covers, respectively, each said rib tangentially aligned with respect to the ribs on adjacent covers, the radially extensive edge of said rib in close proximity to yet spaced from the inner surface of the shell to form a radial clearance gap between the inner surface of the shell and said rib, said rib being the only impediment to flow of the elastic fluid between the tips of said plurality of buckets and said inner surface of the shell; and a diaphragm axially spaced from said plurality of buckets and circumferentially disposed around the rotor for directing the elastic fluid into the plurality of buckets, said diaphragm including a plurality of spaced apart nozzle partitions having a root proximate the rotor, said nozzle partitions forming a respective plurality of channels therebetween and an inner ring for fixedly securing at the root said plurality of nozzle partitions including a leading edge and a trailing edge and disposed to include both an axial lean and a tangential lean, each of said axial lean and said tangential lean with respect to a radial reference from the axis of rotation of the rotor, said inner ring including a greater outward radial extent adjacent the leading edge of said nozzle partitions than the outward radial extend adjacent the trailing edge of said nozzle partitions, each of said plurality of nozzle partitions spaced from an adjacent nozzle partition such that the channel therebetween includes a maximum throat and a trailing edge throat, wherein the minimum throat is disposed between the leading edge of the nozzle partition and the trailing edge throat at the root of the nozzle partition and the minimum throat is disposed monotonically more proximate the trailing edge throat at increasing radial distance from the root of said nozzle partition, whereby the margins of the channel define a converging-diverging passageway at least over a portion of the radial extent of the nozzle partition.

2. The stage as in claim 1 wherein said axial lean is less than about 5 degrees.

3. The stage as in claim 1 wherein said tangential lean is less than about 12 degrees.

4. The stage as in claim 1 wherein said minimum throat merges with said trailing edge throat at a predetermined radial distance intermediate the tip and the root of the nozzle partition.

5. The stage as in claim 1 wherein the outward radial extent of said inner ring adjacent the leading edge of said nozzle partitions to a predetermined axial location intermediate said minimum throat and said trailing edge throat at the root of the nozzle partitions defines an arc of a torus wherein the outward radial extent of said inner ring is greater adjacent the leading edge of said nozzle partitions than at the predetermined axial location and wherein the outward radial extent of said inner ring from the predetermined axial location to the portion of said inner ring adjacent the trailing edge of said nozzle partitions defines a conical section such that an extension of the conical section intercepts the plurality of buckets at the intersection of the leading edge and the root of the plurality of buckets.

6. The stage as in claim 1 wherein said rib comprises an abradible material with respect to the inner surface of the shell.

7. The stage as in claim 1 wherein said rib includes a wide, cross-sectional base portion proximate the cover and a radially outwardly progressively narrowing cross-section to the radially extensive edge of said rib.

8. The stage as in claim 1 further comprising a first rib extending radially outward from the tip of each of said plurality of buckets and tangentially aligned with respect to ribs on adjacent ones of said plurality of covers, said first rib in close proximity to ribs on adjacent ones of said plurality of covers, whereby a substantially continuous, radially extending ring is formed between the inner surface of the shell and the tips of said plurality of buckets.

9. The stage as in claim 1 wherein the outer radial tip of each of said plurality of buckets has a lateral hole therethrough;

each of said plurality of covers including at least a pair of oppositely extending lateral tenons; and each cover effective to connect together the outer radial tip of a pair of adjacent buckets by matingly joining the laterally extending tenon with a corresponding lateral hole in the bucket;

each tenon secured to the respective lateral hole with a force adequate to establish optimum aerodynamic configuration of said plurality of buckets when the elastic fluid passes under transonic conditions with respect to the outer radial tips of said plurality of buckets.

10. The stage as in claim 9 wherein each bucket is overtwisted to compensate for untwist due to rotational forces on an equivalent bucket not including said covers in order to achieve the optimum aerodynamic configuration.

11. The stage as in claim 1 wherein the margins of adjacent buckets define a flow passage between said buckets for the elastic fluid, said flow passage having a minimum flow area intermediate the entrance and exit of said flow passage said minimum flow area extending from the tip to a predetermined location intermediate the tip and the root of the bucket.

12. The stage as in claim 1 including a blade lashing device wherein adjacent buckets of said plurality of buckets provide adjacent opposing aerodynamic faces, each opposing aerodynamic face formed with a boss having a lug extending therefrom, said blade lashing device comprising a sleeve interposed between each paid of opposing blade faces and mounted on each pair of opposing lugs wherein the outer margin of said sleeve defines an aerodynamic surface for reducing forces imposed on said sleeve by the elastic fluid.

* * * * *